US009802686B2

(12) United States Patent
Griggs

(10) Patent No.: US 9,802,686 B2
(45) Date of Patent: Oct. 31, 2017

(54) SAILBOAT ACCESSORY PADDLE HEAD

(71) Applicant: Turnabie LLC, Chagrin Falls, OH (US)

(72) Inventor: Steven H. Griggs, Chagrin Falls, OH (US)

(73) Assignee: Turnabie LLC, Chagrin Falls, OH (US)

( * ) Notice: Subject to any disclaimer, the term of this patent is extended or adjusted under 35 U.S.C. 154(b) by 0 days.

(21) Appl. No.: 15/298,843

(22) Filed: Oct. 20, 2016

(65) Prior Publication Data

US 2017/0113770 A1 Apr. 27, 2017

Related U.S. Application Data

(60) Provisional application No. 62/244,234, filed on Oct. 21, 2015.

(51) Int. Cl.
*B63H 16/04* (2006.01)

(52) U.S. Cl.
CPC ..... *B63H 16/04* (2013.01)

(58) Field of Classification Search
CPC ..... B63H 16/04; B25G 3/02
See application file for complete search history.

(56) References Cited

U.S. PATENT DOCUMENTS

| | | | | |
|---|---|---|---|---|
| 1,853,186 | A * | 4/1932 | Wily | B25G 3/02 15/143.1 |
| 4,926,772 | A * | 5/1990 | Bright | B63B 35/7933 114/39.12 |
| 5,322,462 | A | 6/1994 | Hull et al. | |
| 8,100,733 | B1 | 1/2012 | Ross et al. | |
| 8,926,384 | B1 | 1/2015 | Alphin | |
| 2011/0027101 | A1 | 2/2011 | Hartman | |
| 2014/0271224 | A1 | 9/2014 | Bergman | |

OTHER PUBLICATIONS

U.S. Searching Authority, International Search Report and Written Opinion issued for corresponding application No. PCT/US2016/057894 (dated Dec. 23, 2016).

Backwater Paddle Company, "Assassin Kayak Paddle Standing Up", YouTube, Sep. 30, 2015.[Retrieved Dec. 3, 2016] Retrieved from Internet:<URL: https://www.youtube.com/watch?v=XrjKuMgjjCl> entire video.

* cited by examiner

*Primary Examiner* — Edwin Swinehart
(74) *Attorney, Agent, or Firm* — Fay Sharpe LLP

(57) ABSTRACT

The present application relates to an accessory paddle head for use with a spinnaker pole. The accessory paddle head is adapted to releasably connect to a spinnaker pole to provide a paddle system. The accessory paddle head surface optionally includes gripping members disposed on its surface for engaging with and detachably securing the spinnaker pole. The accessory paddle head is optionally formed of molded material.

29 Claims, 8 Drawing Sheets

SAILBOAT ACCESSORY PADDLE HEAD

The present invention claims priority on U.S. Provisional Patent Application Ser. No. 62/244,234, filed Oct. 21, 2015, which is incorporated herein by reference.

The present invention relates to an accessory for watercraft, particularly to an accessory for sailboats, and more particularly with an accessory paddle head which can be attached to a spinnaker pole to provide a paddle system.

BACKGROUND ON THE INVENTION

Sailboats of various sizes typically employ a sail known as a spinnaker from the mast when sailing with the wind. The spinnaker usually requires a pole which extends perpendicularly from the mast to one corner of the spinnaker sail for control of the spinnaker sail. When the spinnaker sail is not in use, the spinnaker pole is usually stored on the deck, secured to the boat such as, for example, by fittings on the deck of the boat, and/or alternatively placed unsecured or partially secured to the deck of the boat.

It is not uncommon for people using sailboats to experience calm or low-wind conditions. If the sailboat does not have an operable motor, and a conventional paddle is not present, the sailor can become trapped by these unfavorable weather conditions. Conventional paddles are often bulky, and thus are often undesirable for sailors to carry on a small sailboat. If such a situation arises a fair distance from shore, the sailor typically must paddle the sailboat back to shore using their hands and/or feet.

In view of the prior art, there remains a need for an accessory paddle head which can be easily and conveniently attached to an existing sailboat component, and which can be easily and conveniently stored on a sailboat when not in use. Since space inside a small sailboat is limited and a spinnaker pole is usually present, it would be advantageous to provide an accessory paddle head for attachment to a spinnaker pole to provide an accessory paddle system.

SUMMARY OF THE INVENTION

The present invention relates to an accessory paddle head which can be attached to a spinnaker pole to provide an accessory paddle system, and will be described with particular reference thereto. However, it can be appreciated that the presently described accessory paddle head is also amenable to other like applications.

In one non-limiting aspect of the present invention, there is provided an accessory paddle head configured to be attached to a portion of a spinnaker pole. As can be appreciated, the accessory paddle head of the present invention can be attached to other types of poles. Spinnaker poles usually include a spinnaker pole body which is typically cylindrical in shape, and which provides a first end and a second end; however, this is not required. As can be appreciated, the spinnaker pole body can have other or alternative shapes. Typically, at least one end of the spinnaker pole includes a connection arrangement suitable for attachment to a portion of a mast, and at least one end which includes a spinnaker pole head unit. The spinnaker pole head unit often comprises a C-shape defining a slot and/or passage which is bound by a quick release fitting; however, this is not required. When used in conjunction with a spinnaker sail, the slot and/or passage of the spinnaker pole head unit is configured to facilitate movement of a rope therethrough while the quick release fitting is configured to prevent the rope from being displaced therefrom. The type of quick release fitting is non-limiting and can be a spring-loaded quick release fitting; however, this is not required. The spring-loaded quick release fitting (when used) can be manually operated so as to open or close the slot and/or passage of the spinnaker pole head unit; however, this is not required. The accessory paddle head of the present invention can be easily and conveniently releasably connected to a spinnaker pole such that the spinnaker pole can be used in an ordinary manner in which such devices are used. One non-limiting advantage of the accessory paddle head of the present invention is that, when detached from a spinnaker pole, the accessory paddle head can be easily and conveniently stored on board the vessel.

In another and/or alternative non-limiting aspect of the present invention, the size, shape, and material of the accessory paddle head are non-limiting. In one non-limiting configuration, the accessory paddle head has a front and back surface and wherein at least a portion of the front and back surfaces is substantially flat and generally planar shape; however, this is not required. In another and/or alternative non-limiting configuration, the accessory paddle head includes peripheral edge extending around the accessory paddle head, the peripheral edge comprising: a coupling edge; a distal edge, the distal edge being spaced apart and approximately parallel to the coupling edge; a first side edge, the first side edge extending from the coupling edge to the distal edge; and a second side edge, the second side edge spaced apart and approximately parallel to the first side edge and extending from the coupling edge to the distal edge; however, this is not required. The coupling edge, the distal edge and the first and second side edges can be marginally continuous through the corners; however this is not required. In the non-limiting embodiment, when the accessory paddle head has a generally square shape, the coupling edge, distal edge and first and second side edges are approximately equal in length; however, this is not required. As can be appreciated, the length of one or more edges of the accessory paddle head can be adjusted so as to provide an accessory paddle head of other or alternative shapes (e.g., square, trapezoidal, rectangular, oval, circular, polygonal, etc.); however, this is not required. In one non-limiting embodiment, length of the one or more of the edges is typically about 4 inches to about 20 inches (and all ranges or values therebetween), more typically about 6 inches to about 18 inches, and still more typically about 10 inches to about 16 inches; however, this is not required. In one specific non-limiting embodiment, the accessory paddle head has all of the edges about the same length of 10.75 inches; however, this is not required. In another and/or alternative non-limiting embodiment of the present invention, the maximum thickness of the accessory paddle head is typically about 0.05 inches to about 6 inches (and all ranges or values therebetween), more typically about 0.08 inches to about 4 inches, and more typically about 1 inch to about 2 inches; however, this is not required. In one specific non-limiting embodiment, the maximum thickness of the accessory paddle head is about 1.67 inches; however, this is not required. As can be appreciated, the accessory paddle head can have other or alternative dimensions. In one non-limiting configuration, the shape and length of the first and second side edges are generally the same; however, this is not required.

In another and/or alternative non-limiting aspect of the present invention, the thickness of the accessory paddle head is configured to be variable; however, this is not required. In one non-limiting configuration, the midregion of the accessory paddle head is thicker than the outer peripheral edge of the distal edge, the first side edge, and/or the second side edge of the accessory paddle head. In another and/or alternative non-limiting arrangement, the thickness of the accessory paddle head is configured to be tapered in one or more regions; however, this is not required. In one non-limiting configuration, when the accessory paddle head has a tapered thickness, the thickness at the regions that terminate at the distal edge, the first side edge, and/or the second side edge of the accessory paddle head can taper such that the thickness of the outer peripheral edge of the distal edge, the first side edge, and/or the second side edge of the accessory paddle head represents the thinnest width of the accessory paddle head. In one specific non-limiting configuration, the thickness at the regions that terminate at the distal edge, the first side edge, and the second side edge of the accessory paddle head all taper and have the same thickness. One non-limiting advantage to such a configuration is that the overall weight of the accessory paddle head is significantly decreased while both the rigidity and durability of the accessory paddle head are sufficiently maintained. In one non-limiting embodiment, the maximum thickness of the regions that terminate at the distal edge, the first side edge, and the second side edge of the accessory paddle head is about 0.02 inches to about 2 inches (and all ranges or values therebetween), more typically about 0.05 inches to about 1 inch, and more typically about 0.1 inches to about 0.4 inches; however, this is not required. In another and/or alternative non-limiting embodiment, the maximum thickness of the outer peripheral edge of the distal edge, the first side edge, and/or the second side edge of the accessory paddle head is about 0.01 inches to about 1.5 inches (and all ranges or values therebetween), more typically about 0.05 inches to about 1 inch, and still more typically about 0.08 inches to about 0.30 inches; however, this is not required. In one specific non-limiting embodiment, the maximum thickness of the regions that terminate at the distal edge, the first side edge, and the second side edge of the accessory paddle head is about 0.20 inches and the maximum thickness of the outer peripheral edge of the distal edge, the first side edge, and/or the second side edge of the accessory paddle head is about 0.10 inches; however, this is not required. In another and/or alternative non-limiting arrangement, the thickness of the accessory paddle head can begin to taper from the peripheral edge of the distal edge, the first side edge, and/or the second side edge of the accessory paddle head a distance that is about 2-48% (and all values and ranges therebetween) of the maximum length and/or maximum width of the accessory paddle head. For example, if the width of the accessory paddle head is about 12 inches, the taper can begin from the peripheral edge of the first side edge and/or the second side edge of the accessory paddle head a distance of 0.24 inches to 5.76 inches. In one non-limiting configuration, the thickness of the accessory paddle head begins to taper from the peripheral edge of the first side edge, and/or the second side edge of the accessory paddle head a distance that is about 10-30% (and all values and ranges therebetween) of the maximum width of the accessory paddle head. In another non-limiting configuration, the thickness of the accessory paddle head begins to taper from the peripheral edge of the distal edge of the accessory paddle head a distance that is 10-30% (and all values and ranges therebetween) of the maximum length of the accessory paddle head. The taper (when used) can be continuous or non-continuous along the region that includes the taper.

In another and/or alternative non-limiting aspect of the present invention, the accessory paddle head includes a pole connection arrangement that is configured to releasably connect a pole to the accessory paddle head. The pole connection arrangement extends inwardly from the coupling edge of the accessory paddle head. In one non-limiting arrangement, the pole connection arrangement extends inwardly and approximately perpendicularly (e.g., 85-95°) of the coupling edge; however, this is not required. In one non-limiting configuration, the pole connection arrangement includes a first pole retention arrangement and a second pole retention arrangement wherein the first pole retention arrangement is spaced closer to the coupling edge of the accessory paddle head than the second pole retention arrangement. The size, shape and configuration of the pole connection arrangement are non-limiting. In one specific non-limiting embodiment of the present invention, the length of the pole connection arrangement is generally greater or equal to the width of the pole connection arrangement; however, this is not required. In one specific non-limiting configuration, the length of the pole connection arrangement is generally about 20-95% (and all values and ranges therebetween) of the maximum length of the accessory paddle head, and typically about 30-90% of the maximum length of the accessory paddle head, and still more typically about 50-85% of the maximum length of the accessory paddle head. In another specific non-limiting configuration, the maximum width of the pole connection arrangement is generally about 10-90% (and all values and ranges therebetween) of the maximum width of the accessory paddle head, and typically about 20-70% of the maximum width of the accessory paddle head, and still more typically about 40-60% of the maximum width of the accessory paddle head.

In another and/or alternative non-limiting aspect of the present invention, the first pole retention arrangement extends inwardly from the coupling edge. In one non-limiting arrangement, the first pole retention arrangement extends inwardly and approximately perpendicularly (e.g., 85-95°) from a midpoint of the coupling edge and thereby defines a first cavity that is configured to receive a portion of a pole; however, this is not required. In such a configuration, the first cavity is generally semicircular or U-shape; however, this is not required. As can be appreciated, the first cavity can have other or alternative shapes. The size and shape of the first pole retention arrangement is non-limiting. In one non-limiting embodiment, the maximum width of the first cavity is the same or less than a maximum length of the cavity; however, this is not required. In one specific non-limiting embodiment of the present invention, the first cavity has a maximum width of about 0.2 inches to about 3 inches (and all values and ranges therebetween) and a length of about 1 inch to about 6 inches (and all values and ranges therebetween); however, this is not required. In one non-limiting configuration, the maximum length of the first cavity is greater than the maximum width of the first cavity. Generally, the maximum length of the first cavity is about 4-35% (and all values and ranges therebetween) the maximum length of the accessory paddle head, more typically about 5-25% the maximum length of the accessory paddle head, and still more typically from about 10-20% the maximum length of the accessory paddle head. Generally, the maximum width of the first cavity is about 2-25% (and all values and ranges therebetween) the maximum width of the accessory paddle head, more typically about 4-15% the maximum width of the accessory paddle head, and still more typically from about 5-10% the maximum width of the accessory paddle head. The first cavity is configured to receive at least a portion of a pole (i.e. a spinnaker pole head unit and/or a spinnaker pole body); however, this is not required. The first cavity generally extends downwardly from the top or upper surface of the accessory paddle head; however, this is not required. In one non-limiting configuration, the top opening of the first cavity lies in the same plane as the top surface of the accessory paddle head; however, this is not required. A portion or the entire outer surface of the first pole retention arrangement that forms the cavity extends outwardly from the bottom surface of the first pole retention arrangement. The outer surface of the first pole retention arrangement can have a generally curved shape (e.g., C-shape, U-shape, etc.); however, this is not required. When the shape of the first cavity is semicircular, the depth of the first cavity is equal to 50% of the width of the cavity. The thickness of the wall that forms the outer surface of first pole retention arrangement is generally 60-400% (and all values and ranges therebetween) the thickness of the distal edge of the accessory paddle head, and more typically about 100-200% the thickness of the distal edge of the accessory paddle head.

In another and/or alternative non-limiting aspect of the present invention, the first pole retention arrangement optionally includes one or more gripping members. The gripping members (when used) are configured to facilitate in maintaining a portion of a pole in the first cavity. The size, shape, material and number of gripping members are non-limiting. In one specific non-limiting embodiment, one or more gripping members are located on the top surface of the accessory paddle head and are positioned at or closely adjacent to one or both sides of the first cavity; however, this is not required. In one non-limiting configuration, there is provided one or more gripping members on each side of the first cavity. In another non-limiting configuration, the size and shape of the gripping members are the same; however, this is not required. In one non-limiting design, each gripping member is generally pyramidal in shape, and extends outwardly from the top surface of the accessory paddle head; however, this is not required. In such a design, the cross-sectional shape of the gripping member is substantially triangular; however, this is not required. In one non-limiting arrangement, at least a portion of an inner surface of one or more of the gripping member extends over the first cavity; however, this is not required. In such arrangement, the pole is required to be snapped into the first cavity since the distance between one or more portions of the inner surface of the gripping member and the first cavity is less than a width of the pole; however, this is not required. In one non-limiting arrangement, one gripping member is positioned on one side of the first cavity and another gripping member is positioned on the other side of the first cavity such that a portion or the entire inner surface of two gripping members are positioned diametrically apart from one another; however, this is not required. The distance between the inner surface of the two gripping members can be equal to or slightly less than the width of the first cavity; however, this is not required. When the distance between the inner surface of the two gripping members is less than the width of the first cavity, a portion of the spinnaker pole is frictionally slid past the gripping members and into the first cavity; however, this is not required.

In another and/or alternative non-limiting aspect of the present invention, the second pole retention arrangement is spaced inwardly from the first pole retention arrangement; however, this is not required. The size, shape and configuration of the second pole retention arrangement are non-limiting. When the second pole retention arrangement is spaced from the first pole retention arrangement, there is generally provided an opening in the accessory paddle head that defines all or a portion of the space between the first and second pole retention arrangements. The width of the opening along a longitudinal length of the opening is generally equal to or greater than a width of the first cavity of the first pole retention arrangement. The width of the opening can be constant or vary along the longitudinal length of the opening. In one non-limiting configuration, the width of the opening along a longitudinal length of the opening is greater than the width of the first cavity. In such a configuration, the maximum width of the opening along a longitudinal length of the opening is about 5-200% (and all values and ranges therebetween) greater than the maximum width of the first cavity, and typically about 20-100% greater than the maximum width of the first cavity. The length of the opening can be the same as, less than, or greater than a maximum width of the opening. In one non-limiting configuration, the length of the opening is the same as or greater than a maximum width of the opening. The shape of the opening is non-limiting (e.g., square-shaped, rectangular-shaped, oval-shaped, circular-shaped; etc.). The corners, if any, of the opening can be curved; however, this is not required.

In another and/or alternative non-limiting aspect of the present invention, the second pole retention arrangement includes a second cavity that faces in an opposite direction of the first cavity of the first pole retention arrangement; however, this is not required. The longitudinal axis of the first and second cavities is generally the same so as to facilitate in positioning the pole in both the first and second cavities when the pole is releasably connected to the accessory paddle head. The second cavity is generally semicircular or U-shape; however, this is not required. As can be appreciated, the second cavity can have other or alternative shapes. In one non-limiting embodiment, the maximum width of the second cavity is the same or less than a maximum length of the second cavity; however, this is not required. In one specific non-limiting embodiment of the present invention, the second cavity has a maximum width of about 0.2 inches to about 3 inches (and all values and ranges therebetween) and a maximum length of about 1 inch to about 10 inches (and all values and ranges therebetween); however, this is not required. In one non-limiting configuration, the maximum length of the second cavity is greater than the maximum width of the second cavity. In another one non-limiting configuration, the maximum length of the second cavity is greater than the maximum length of the first cavity; however, this is not required. Generally, the maximum length of the first cavity is about 10-80% (and all values and ranges therebetween) the maximum length of the accessory paddle head, more typically about 15-60% the maximum length of the accessory paddle head, and still more typically from about 30-50% the maximum length of the accessory paddle head. Generally, the width of the second cavity is about 2-25% (and all values and ranges therebetween) the maximum width of the accessory paddle head, more typically about 4-15% the maximum width of the accessory paddle head, and still more typically from about 5-10% the maximum width of the accessory paddle head. The second cavity is configured to receive at least a portion of a pole (i.e., a spinnaker pole head unit and/or a spinnaker pole body); however, this is not required. Generally, the end or end portion of the pole is releasably connected to the second cavity. The second cavity generally extends upwardly from the top or upper surface of the accessory paddle head; however, this is not required. In one non-limiting configuration, the top opening of the second cavity lies in the same plane as the bottom surface of the accessory paddle head; however, this is not required. A portion or the entire outer surface of the second pole retention arrangement that forms the second cavity extends upwardly or outwardly from the top surface of the first pole retention arrangement. The outer surface of the second pole retention arrangement can have a generally curved shape (e.g., C-shape, U-shape, etc.); however, this is not required. When the shape of the second cavity is semicircular, the depth of the second cavity is equal to 50% of the width of the second cavity. The thickness of the wall that forms the outer surface of the second pole retention arrangement is generally 60-400% (and all values and ranges therebetween) the thickness of the distal edge of the accessory paddle head, and more typically about 100-200% the thickness of the distal edge of the accessory paddle head.

In another and/or alternative non-limiting aspect of the present invention, the second pole retention arrangement optionally includes one or more gripping members. The gripping members (when used) are configured to facilitate in maintaining a portion of a pole in the second cavity. The size, shape, material and number of gripping members are non-limiting. In one specific non-limiting embodiment, one or more gripping members are located on the bottom surface of the accessory paddle head and are positioned at or closely adjacent to one or both sides of the second cavity; however, this is not required. In one non-limiting configuration, there is provided one or more gripping members on each side of the second cavity. In another non-limiting configuration, the size and shape of the gripping members are the same; however, this is not required. In one non-limiting design, each gripping member is generally pyramidal in shape, and extends outwardly from the bottom surface of the accessory paddle head; however, this is not required. In such a design, the cross-sectional shape of the gripping member is substantially triangular; however, this is not required. As can be appreciated, when gripping members are used in association with the first and second cavities, the gripping members can have the same size, shape and configuration; however, this is not required. In one non-limiting design, there are gripping members that are associated with both the first and second cavities and the size, shape and configuration are the same. In another non-limiting design, there are gripping members that are associated with both the first and second cavities and number of gripping members associated with the first cavity is the same or less than the number of gripping members associated with the second cavity. In another non-limiting arrangement, at least a portion of an inner surface of one or more of the gripping member extends over the second cavity; however, this is not required. In such arrangement, the pole is required to be snapped into the second cavity since the distance between one or more portions of the inner surface of the gripping member and the second cavity is less than a width of the pole; however, this is not required. In one non-limiting arrangement, one gripping member is positioned on one side of the second cavity and another gripping member is positioned on the other side of the second cavity such that a portion or the entire inner surface of two gripping members are positioned diametrically apart from one another; however, this is not required. The distance between the inner surface of the two gripping members can be equal to or slightly less than the width of the second cavity; however, this is not required. When the distance between the inner surface of the two gripping members is less than the width of the second cavity, a portion of the spinnaker pole is frictionally slid past the gripping members and into the second cavity; however, this is not required.

In another and/or alternative non-limiting aspect of the present invention, the first cavity of the first pole retention arrangement and/or the second cavity of the second pole retention arrangement can be integrally formed with the body of the accessory paddle head or be connected to the body of the accessory paddle head by various means (e.g., adhesive, melted connection, screw, rivet, etc.).

In another and/or alternative non-limiting aspect of the present invention, the second cavity of the second pole retention arrangement can include an upper hole that is located at or near a rear or back end (i.e., the end farthest from the coupling edge of the accessory paddle head) of the second cavity; however, this is not required. The upper hole is typically positioned at the bottom center of the second cavity; however, this is not required. The size and shape of the upper hole are non-limiting. In one non-limiting configuration, the maximum length of the upper hole is greater than a maximum width of the upper hole; however, this is not required. In one non-limiting design, the maximum width of the upper hole is about 2-50% (and all values and ranges therebetween) the maximum width of the second cavity, and typically about 5-20% the maximum width of the second cavity. In another non-limiting design, the maximum length of the upper hole is about 2-80% (and all values and ranges therebetween) the maximum length of the second cavity, and typically about 5-60% the maximum length of the second cavity. In another non-limiting design, the longitudinal axis of the upper hole is parallel to a longitudinal axis of the second cavity; however, this is not required. The upper hole (when used) is configured to facilitate movement of a quick release fitting of a spinnaker pole head unit; however, this is not required. As such, during attachment of the accessory paddle head to a spinnaker pole, the spinnaker pole head unit is typically oriented such that at least a portion of the quick release fitting faces the upper hole in the second cavity; however, this is not required.

In another and/or alternative non-limiting aspect of the present invention, the second pole retention arrangement includes a connection bar that is used to facilitate in releasably securing a pole in the second cavity; however, this is not required. The size, shape and configuration of the connection bar are non-limiting. In one non-limiting design, the connection bar is in the form of a dowel pin. The connection bar is positioned partially or fully across a width of the second cavity. The connection bar can be connected to one or more gripping members positioned about the second cavity and/or can be connected to a portion of a side wall of the second cavity. In one non-limiting arrangement, the connection bar is positioned partially or fully over a width of the upper opening in the second cavity; however, this is not required. In one non-limiting design, the longitudinal axis of the connection bar is generally perpendicular to the longitudinal axis of the upper opening; however, this is not required. In another non-limiting arrangement, the connection bar is positioned at or near the back of the second cavity. In one non-limiting specific configuration, the connection bar is spaced from the front and back of the second cavity. In another non-limiting specific configuration, the connection bar is spaced from the front and back of the second cavity and is located closer to the back of the second cavity than to the front of the second cavity. In another non-limiting specific configuration, the connection bar is formed of a rigid material, such as, for example, a metal material (e.g., steel, stainless steel, galvanized steel, etc.); however, other and/or alternative materials can be used (e.g., plastic material, composite material, etc.). In another and/or alternative non-limiting embodiment, when the accessory paddle head is attached to the end of a spinnaker pole, the spinnaker pole head unit is positioned at or near the connection bar; however, this is not required. The connection bar can be added before, during, or after the accessory paddle head is formed. In one non-limiting embodiment, the connection bar can be inserted into the accessory paddle head shortly after the accessory paddle head is formed such that when the material of the accessory paddle head cools, the material shrinks, thereby trapping the connection bar securely to the accessory paddle head; however, this is not required. The size and shape of the accessory paddle head can be selected for the purpose of accommodating different spinnaker pole types. In this regard, the clasping diameter of the open passage created by the quick release fitting and head unit of the spinnaker pole varies among spinnaker pole types. In another and/or alternative non-limiting aspect of the present invention, a bushing (e.g., nylon bushing, etc.) with a longitudinal slit can optionally be placed over the accessory paddle head for the purpose of minimizing movement of the spinnaker pole head unit relative to the accessory paddle head; however, this is not required. The bushing can be configured to be a compressible material such that the material can be compressed when the quick release fitting is being connected to the accessory paddle head, and then expanded once the quick release fitting has been secured; however, this is not required.

In another and/or alternative non-limiting aspect of the present invention, there is provided a plurality of gripping members associated with both the first and second cavities. In one non-limiting arrangement, each gripping member can optionally have a curved end designed to extend at least partially over the side edge of the first and/or second cavities; however, this is not required. As such, the curved end of the gripping members can provide a surface by which the spinnaker pole must be frictionally slid; however, this is not required. In another and/or alternative non-limiting aspect of the present invention, the material of the gripping members is the same as the material of the accessory paddle head; however, this is not required. As can be appreciated, the material of the gripping members can include an additive so as to increase the frictional engagement between the gripping member and the spinnaker pole.

In another and/or alternative non-limiting aspect of the present invention, the gripping members are designed to be of proper size so as to extend partially over the spinnaker pole, thereby firmly holding the spinnaker pole against the gripping members when the spinnaker pole is releasably attached to the accessory paddle head; however, this is not required. In this regard, the gripping members can be designed to frictionally enclose the spinnaker pole when releasably attached to the accessory paddle head so as to restrain the spinnaker pole from relative movements therein.

In another and/or alternative non-limiting aspect of the present invention, there is provided an accessory paddle head which includes one or more cutouts along a peripheral edge of the accessory paddle head; however, this is not required. The one or more cutouts (when used) can be configured to be used to hook lines or ropes which are typically required for operation of a sailboat; however, this is not required. In certain situations, such as, for example, in high wind situations, it is possible for an operator to drop a rope into the water. As such, the one or more cutouts on the accessory paddle head can be used to easily and conveniently hook and retrieve the rope from the water. In this regard, the accessory paddle head of the present invention having one or more cutouts along an edge thereof can serve as a multi-purpose tool (e.g., as an accessory paddle system and/or as a rope hook); however, this is not required. In one non-limiting arrangement, the accessory paddle head includes two cutouts, the two cutouts being provided at or near the corners of the accessory paddle head where the first and second side edges meet the distal edge; however, other or alternative arrangements can be used. In another and/or alternative non-limiting arrangement, the cutouts are provided along the first and second side edges of the accessory paddle head a distance of about 1-5 inches from the distal edge of the accessory paddle head; however, this is not required. The two cutouts can optionally extend into the accessory paddle head at an angle, such as, for example, of about 90-150° (and all values and ranges therebetween) from the first and second side edges of the accessory paddle head; however, other or alternative configurations can be used. In one non-limiting design, one or both of the cutouts are at an angle of about 120-140° (e.g., 130°) from the first and second side edges of the accessory paddle head. Generally, the width of the one or more cutouts is about 0.5-2 inches (and all values and ranges therebetween) so as to accommodate ropes of various thicknesses; however, other or alternative sizes can be used.

In another and/or alternative non-limiting aspect of the present invention, the accessory paddle head of the present invention can be attached to the end of a spinnaker pole by inserting the end of the spinnaker pole into the first cavity of the first pole retention arrangement and the second cavity of the second pole retention arrangement. The upper hole in the second cavity is configured to receive at least a portion of the quick release fitting of the spinnaker pole head unit when the pole is releasably connected to the second cavity; however, this is not required. When the accessory paddle head is connected to the spinnaker pole, the accessory paddle head inhibits or prevents the spinnaker pole from rotating relative to the accessory paddle head or inadvertently fully disconnecting from the accessory paddle head due to the quick release fitting and the head unit of the spinnaker pole being connected to the connection bar. The secure nature of the connection between the spinnaker pole and the accessory paddle head stiffens the provided accessory paddle system such that it may be used for heavy or excessive paddling as needed. By supporting the accessory paddle head on the spinnaker pole, the latter is convenient for use during paddling operations.

In another and/or alternative non-limiting aspect of the present invention, the unique engagement and/or fitting between the accessory paddle head and spinnaker pole provides the non-limiting advantage that overall strength of the accessory paddle system when striking the water with one side of the accessory paddle system can be the same as when striking the water with the opposite surface of the accessory paddle system, a feature typically absent in existing accessory paddles. Thus, the provided accessory paddle system's overall strength is improved and is due in part to the unique means of detachably securing the accessory paddle head to the spinnaker pole.

In another and/or alternative non-limiting aspect of the present invention, the material of the accessory paddle head is non-limiting. In one non-limiting embodiment, the material of the one or more components of the accessory paddle head can be a high-density polyethylene (HDPE) plastic, a low-density polyethylene (LDPE) plastic, a rubber material, polyvinyl chloride (PVC), various types of resins, various types of resin epoxides, polyester, polypropylene, polyurethane, polyacrylate, and copolymers thereof, etc. In another non-limiting embodiment, the material of the one or more components of accessory paddle head can be a silicone rubber or similar material, having sufficient flexibility to prevent breakage of the accessory paddle head; however, this is not required. As can be appreciated, the accessory paddle head of the present invention can be formed from other or additional materials (e.g., metal, wood, composite materials, ceramic, etc.). In another and/or alternative non-limiting embodiment of the accessory paddle head of the present invention, the accessory paddle head can be optionally formed from a chosen formula of polymer plastic resins or co-polymer resins, and be formed by an injection molding process or other type of process. The plastic material can be any of a number of polymer plastics and/or co-polymer plastics. In one non-limiting arrangement, the plastic used to form the accessory paddle head can be a polypropylene co-polymer.

In another and/or alternative non-limiting aspect of the present invention, the accessory paddle head is formed from a single piece of material; however, this is not required. Such an arrangement substantially minimizes the volume of fluid that can flow into and fill the accessory paddle head. In another and/or alternative non-limiting aspect of the present invention, the material used to form the accessory paddle head is typically a light weight and/or buoyant material; however, this is not required. The accessory paddle head can be formed form a single material, such as by molding, blow bolding, casting, etc.

In another and/or alternative non-limiting aspect of the present invention, the accessory paddle head can be designed to be symmetrical; however, this is not required. The symmetric configuration of the accessory paddle head provides functional benefits as well as providing a unique and aesthetic appearance. For example, in use, functional use of the accessory paddle head is not limited by the orientation of the accessory paddle in the water.

In another and/or alternative non-limiting aspect of the present invention, the unique design, size and shape of the accessory paddle head of the present invention permits its easy and convenient storage in a small sailing vessel where space is typically at a premium. As such, in an emergency (e.g., when a regular paddle goes overboard, when a regular paddle is lost, when there is insufficient wind to sail, when there is no wind, when the motor to propel the boat is not usable, when there is no motor to propel the boat, etc.), the accessory paddle head can be quickly and easily removed from storage on the small sailing vessel and connected to a spinnaker pole, thereby providing an accessory paddle system.

In another and/or alternative non-limiting aspect of the present invention, the accessory paddle head optionally has no hinges (e.g., living hinges), slits, or cuts in the material forming the accessory paddle head. Such an arrangement substantially minimizes the volume of fluid that can flow into and fill the accessory paddle head.

In another and/or alternative non-limiting embodiment, the overall structure of the accessory paddle head is rigid and does not allow or resists bending; however, this is not required. The accessory paddle head can optionally be absent crimps, heat bends, slits, or living hinges, thereby minimizing the volume of fluid that can flow into and fill the accessory paddle head during use.

In another and/or alternative non-limiting aspect of the present invention, the front and/or back surfaces of the accessory paddle head can optionally include various types of information impressed or otherwise formed into the material of the accessory paddle head (e.g., labels, product information, information on how to use the accessory paddle head, safety information, barcodes, brand names, shapes, designs, etc.); however, this is not required.

One optional non-limiting advantage of the present invention is the inherent ability of the materials used to form the accessory paddle head to float in the water. As can be appreciated, the accessory paddle head can be formed of materials that cause the paddle head to sink in the water. As such, if the paddle blade inadvertently falls into the water, the accessory paddle head will not sink. The accessory paddle head optionally does not include any open-ended flute channels, thus not allowing the accessory paddle head to fill with water. This further adds to the accessory paddle head's buoyancy.

Another optional non-limiting advantage of the present invention is the accessory paddle head can include a connection arrangement (e.g., hole, clip, etc.) for a safety line to prevent the accessory paddle head from sinking in the water around the boat. The size, shape and location of the connection arrangement on the accessory paddle head is non-limiting.

Yet another optional non-limiting advantage of the present invention is the accessory paddle head's low cost due to simple manufacturing processes and its relatively simple design.

Still yet another non-limiting advantage of the present invention is the accessory paddle head's structure in that it is generally compact and provides easy and convenient storage within a sailing vessel.

Another non-limiting advantage of the present invention is the unique arrangement used to secure the accessory paddle head to a spinnaker pole. The engagement between the accessory paddle head and the spinnaker pole enables the accessory paddle head to be equal in strength when used in one direction as the when used in the other direction.

Another non-limiting advantage of the present invention is that in use, the accessory paddle head's overall structure remains rigid and maintains its original posture; however, this is not required and is dependent on the type of material used. For example, when a stroke is made, the thinner, perimeter surfaces of the accessory paddle head can bow slightly, but when the accessory paddle head is lifted from the water and pressures are removed, the material's residual memory regains its original posture. Thus, the stroke force can be maximized during use of the accessory paddle head. As can be appreciated, one or more regions of the accessory paddle head can be non-rigid. Also as can be appreciated, the accessory paddle head can be designed to be rigid and not bow when used.

It is accordingly one non-limiting objective of the present invention to provide an accessory paddle head suitable for attachment to a spinnaker pole to provide a useful paddle.

It is another and/or alternative non-limiting objective of the present invention to provide a novel attachment for an accessory paddle head which may be readily detached from a spinnaker pole.

It is another and/or alternative non-limiting objective of the present invention to provide a novel attachment for an accessory paddle head which, when attached to a spinnaker pole, serves as a usable paddle.

It is yet another and/or alternative non-limiting objective of the present invention to provide a novel means for detachably securing the accessory paddle head to a spinnaker pole.

It is another and/or alternative non-limiting objective of the present invention to provide an accessory paddle head having a symmetric configuration which incorporates aesthetic characteristics as well as functional characteristics.

It is another and/or alternative non-limiting objective of the present invention to provide an accessory paddle head which can be easily and conveniently connected to a spinnaker pole to provide a paddle which is especially useful in situations where a paddle is needed or required as in emergency situations.

These and other objects, features and advantages of the present invention will become apparent from the subsequent description taken in conjunction with the accompanying drawings.

BRIEF DESCRIPTION OF THE DRAWINGS

Reference may now be made to the drawings which illustrate various non-limiting embodiments that the invention may take in physical form and in certain parts and arrangements of parts wherein.

DETAILED DESCRIPTION OF NON-LIMITING EMBODIMENTS

Figure 1:
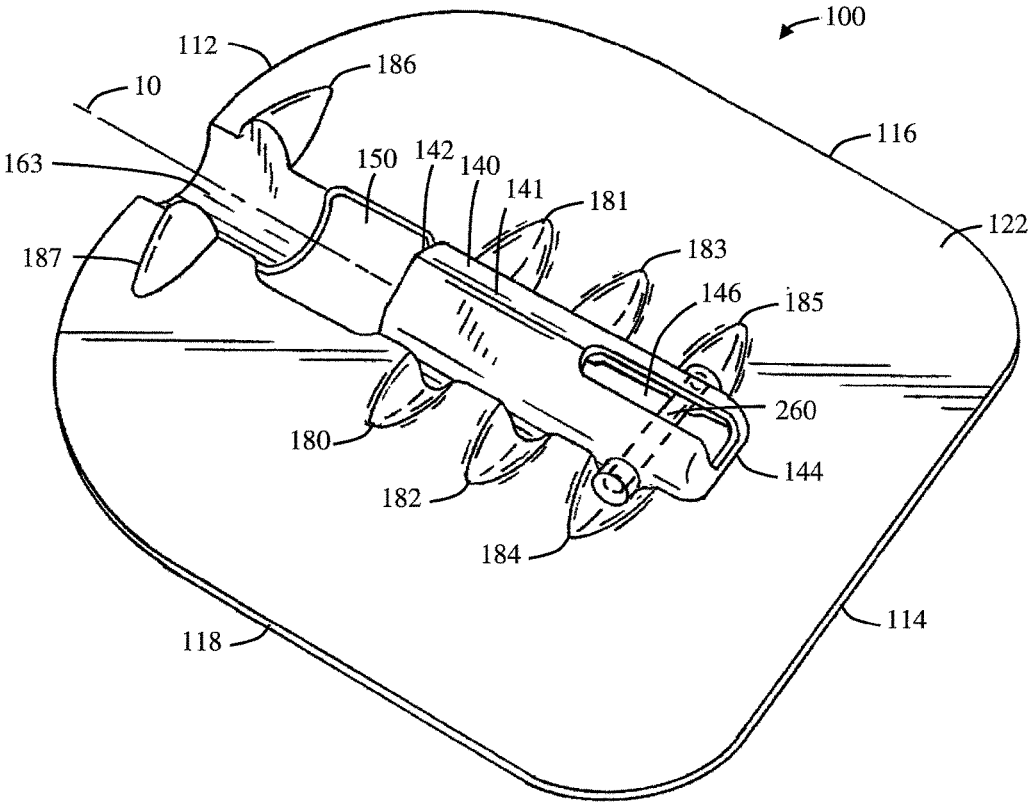
FIG. 1 is a back-view perspective illustration of an accessory paddle head in accordance with one non-limiting aspect of the present invention.

Referring now to the drawings wherein the showing is for the purpose of illustrating non-limiting embodiments of the invention only and not for the purpose of limiting the same, FIGS. 1-10 illustrate various non-limiting versions of an accessory paddle head 100 in accordance with the present invention. The accessory paddle head of the present invention can be attached to a spinnaker pole 200 to provide an accessory paddle system and will be described with particular reference thereto; however, it can be appreciated that the accessory paddle head can be configured to be removable connected to other or additional types of poles.

Figure 2:
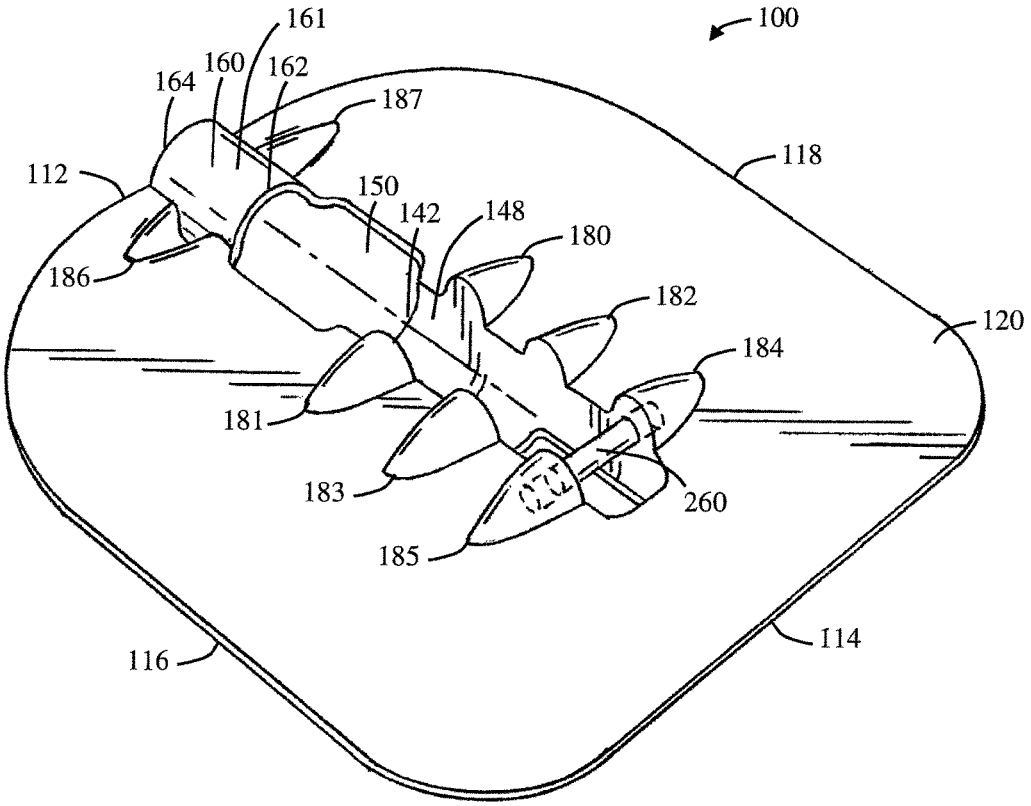
FIG. 2 is a front-view perspective of the accessory paddle head of FIG. 1.

With reference now to FIGS. 1-2, accessory paddle head 100 is illustrated as having a generally square shape and having a coupling edge 112, a distal edge 114, a first side edge 116 and a second side edge 118. Coupling edge 112, distal edge 114, first side edge 116 and second side edge 118 are illustrated as being continuous through the corners and along the peripheral edge of the accessory paddle head 100. Accessory paddle head 100 is also illustrated as having a top or upper surface 122 (see FIG. 1) and a bottom or back surface 120 (see FIG. 2).

With continued reference to FIGS. 1-2, a majority or all of distal edge 114 of accessory paddle head 100 forms a right angle (e.g., about 85°-95°) with axis 10 of accessory paddle head 100; however, this is not required. Axis 10 is also illustrated as bisecting the coupling edge 112 of the accessory paddle head 100, and intersecting a midpoint thereof between first side edge 116 and second side edge 118; however, this is not required. A majority or all of distal edge 114 is parallel with a portion or all of coupling edge 112; however, this is not required. A majority or all of first side edge 116 is parallel with a portion or all of second side edge 118; however, this is not required. The length of the first side edge 116 and the second side edge 118 are generally the same; however, this is not required. A majority of the width of the accessory paddle head 100 along axis 10 is generally constant; however, this is not required. As illustrated in FIG. 1, the coupling edge 112 has a peripheral edge that is more curved than the peripheral edge of the distal edge; however, this is not required. As illustrated in FIG. 1, about 20-60% of the peripheral edge of coupling edge 112 is straight and about 60-95% of the peripheral edge of distal edge 114 is straight.

Figure 5:
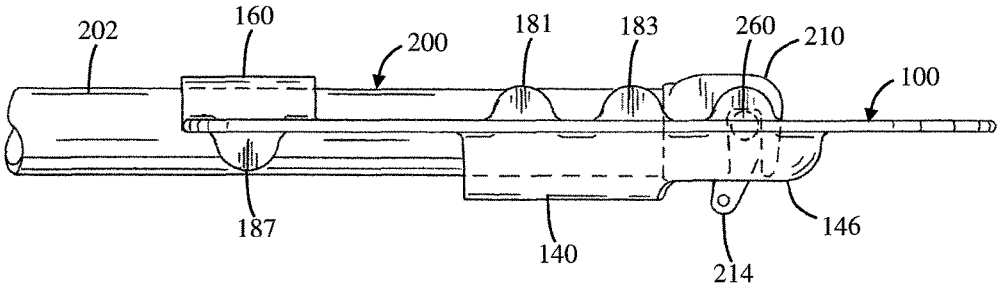
FIG. 5 is a side-view perspective illustration of the accessory paddle head attached to a spinnaker pole.
Figure 6:
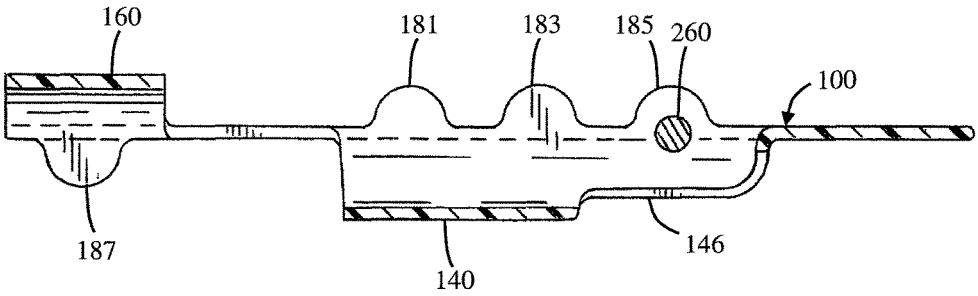
FIG. 6 is a cross-sectional illustration of the accessory paddle head of FIGS. 1-2.

As best illustrated in FIG. 1, the upper surface 122 of the accessory paddle head 100 includes a housing 141 of the second cavity 148 of the second pole retention arrangement 140. The outer surface of the housing of the second cavity is illustrated as being in the shape of a semi-cylindrical member; however, this is not required. The housing 141 is also illustrated as extending upwardly or outwardly from the upper surface 122 of the accessory paddle head 100. Additionally, the second cavity 148 is illustrated as having a first end 142 and a second end 144. The housing 141 is also illustrated as including an upper hole 146 configured to facilitate the positioning and movement of a quick release fitting therein (see FIGS. 3-4). Generally, at least a portion of the maximum depth of the second cavity is greater than a maximum depth of the first cavity; however, this is not required. The depth of the first cavity is measured from the top surface of the accessory paddle head to the bottom inner surface of the first cavity. The depth of the second cavity is measured from the bottom surface of the accessory paddle head to the bottom inner surface of the second cavity. As illustrated in FIGS. 5-6, the front portion of the second cavity (i.e., the region of the second cavity positioned in from of upper opening 146) is greater than the maximum depth of the first cavity. FIGS. 5-6 illustrate that the depth of the first cavity is generally constant along the longitudinal length the first cavity; however, this is not required. FIGS. 5-6 also illustrate that the depth of the second cavity varies along the longitudinal length the first cavity; however, this is not required. As illustrated in FIGS. 5-6, the front portion of the second cavity is greater than the maximum depth of the rear portion of the second cavity; however, this is not required.

As best illustrated in FIG. 2, the bottom surface 120 of accessory paddle head 100 includes a first pole retention arrangement 160. The first pole retention arrangement 160 includes a housing 161 of first cavity 163 having an outer surface in the shape of a semi-cylindrical member; however, this is not required. The housing 161 is also illustrated as extending downwardly or outwardly from the bottom surface 120 of the accessory paddle head 100. A front end 164 of first cavity 163 is illustrated as being positioned at or near the coupling edge 112 of the accessory paddle head, and a rear end 164 of the first cavity 163 is illustrated as terminating into the pole opening 150.

Pole opening 150 is illustrated as being positioned between the first and second pole retention arrangements; however, this is not required. Generally, pole opening 150 is configured to enable an end of a spinnaker pole to be passed through the opening when the spinnaker pole is being connected to or disconnected from the accessory paddle head. The size and shape of the opening is generally selected so that the end of a spinnaker pole can be easily passed through the opening. In such a configuration (not shown), the accessory paddle head 100 is free to move vertically up and/or down the spinnaker pole via pole opening 150 during the connecting or disconnecting of the spinnaker pole to/from the accessory paddle head.

In use, one end of a spinnaker pole can be inserted through the pole opening 150 of the accessory paddle head 100 such that the second pole retention arrangement 140 receives at least a portion of the spinnaker pole head unit, and the first pole retention arrangement 160 receives at least another portion of the spinnaker pole body when the spinnaker pole is releasably connected to the accessory paddle head. Furthermore, in such a configuration, as seen in FIGS. 3-5, a quick release fitting of the spinnaker pole head unit is received by upper hole 146 in the second cavity.

Figure 3:
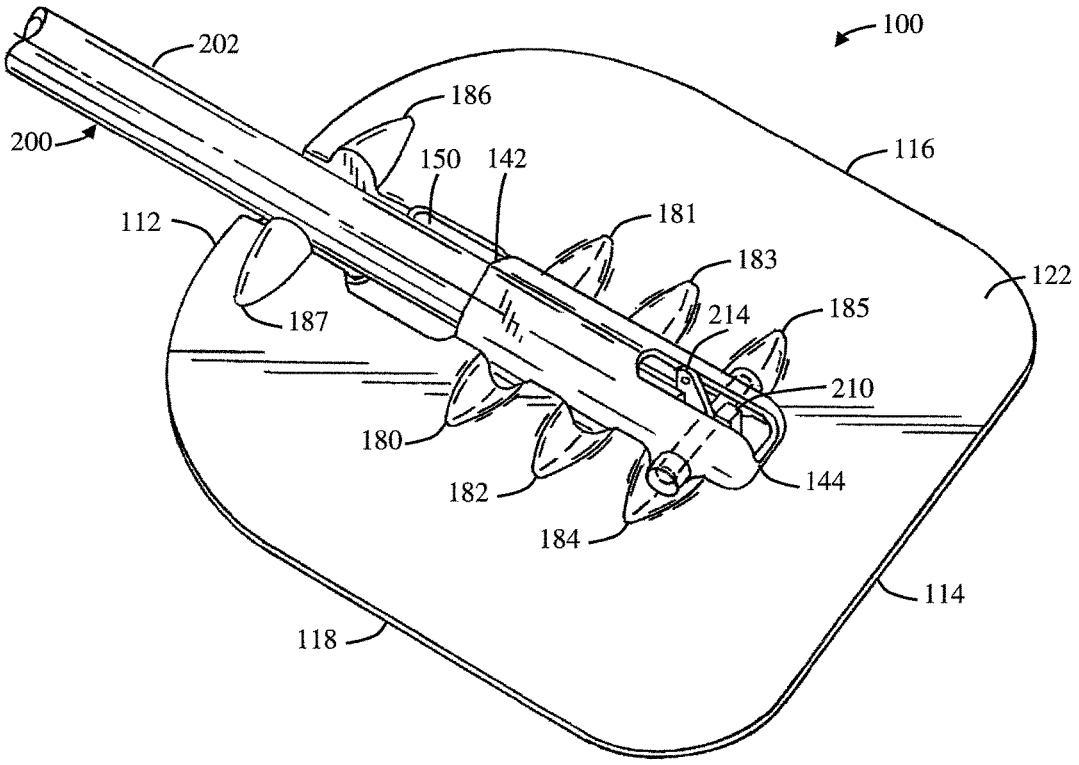
FIG. 3 is a perspective illustration of FIG. 1 wherein the accessory paddle head is attached to a spinnaker pole.
Figure 4:
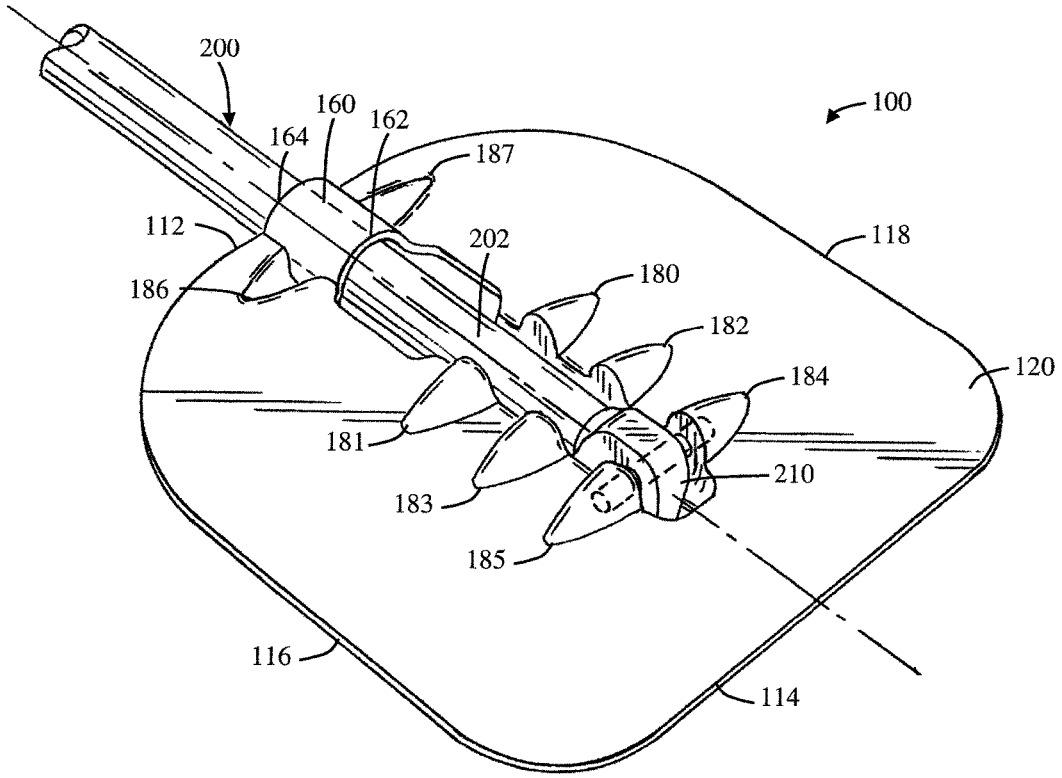
FIG. 4 is a perspective illustration of FIG. 2, wherein the accessory paddle head is attached to a spinnaker pole.

With continued reference to FIGS. 1-4, one or more sets of oppositely disposed gripping members are positioned on the upper surface 122 and bottom surface 120 of the accessory paddle head 100. These gripping members can be molded on the accessory paddle head; however, this is not required. The bottom of the gripping members can include an opening into an internal cavity of the gripping members; however, it can be appreciated that the gripping members can be fully solid or be absent a bottom opening. As can be appreciated, the gripping members 180, 181, 182, 183, 184, 185, 186, 187 can optionally be configured to be detachable and/or releasably secured to the accessory paddle head 100. As illustrated in FIGS. 3-4, gripping members 180, 181, 182, 183, 186, 187 are configured to engage the pole when the pole is releasably connected to the accessory paddle head, and gripping members 184, 185 are spaced from the pole when the pole is releasably connected to the accessory paddle head; however, this is not required.

The gripping members are provided so as to limit the relative movement of a spinnaker pole when positioned in the first and second cavities, while holding the spinnaker pole securely and detachably together with the accessory paddle head 100.

The bottom surface 122 of accessory paddle head 100 is illustrated as including a plurality of gripping members 186, 187 positioned on each side of the first cavity. In this manner, the spinnaker pole body 202 of spinnaker pole 200 (see FIG. 3) is at least partially retained in the first cavity by the gripping members 186, 187; however, this is not required. The bottom surface 120 of accessory paddle head 100 is illustrated as including a plurality of gripping members 180, 181, 182, 183, 184, 185 positioned on each side of the second cavity. In this manner, the spinnaker pole head unit 201 of spinnaker pole 200 (see FIG. 4) is at least partially retained in the second cavity by the gripping members 180, 181, 182, 183, 184, 185; however, this is not required. Generally, the gripping members 180, 181, 182, 183, 184, 185, 186, 187 are configured to be of proper size so as to extend at least slightly over the spinnaker pole 200 when the spinnaker pole is positioned in the first and second cavities, thereby facilitating in the accessory paddle head 100 being held thinly in place thereon. As such, the gripping members 180, 181, 182, 183, 184, 185, 186, 187 at least partially frictionally enclose the spinnaker pole 200 so as to limit relative movements between the accessory paddle head 100 and the spinnaker pole 200.

The accessory paddle head 100 is also illustrated as including a connection bar 260 extending between the adjacent gripping members 184, 185 for insertion into the slot and/or passage 212 of spinnaker pole head unit 210. In one non-limiting embodiment, the material of the connection bar 260 is stainless steel; however, other and/or alternative materials can be used. The connection bar 260 is illustrated as being positioned in a slot of gripping members 184, 185 so as to securely connect the connection bar to accessory paddle head and to prevent the disconnection of the connection bar from the accessory paddle head. As illustrated in FIGS. 5-6, a bottom portion of the connection bar is positioned in the second cavity and a top portion of the connection bar is positioned above the second cavity; however, this is not required. As can be appreciated, the connection bar can be positioned fully in the second cavity or be positioned fully above the second cavity. As can be appreciated, the connection bar can be formed of the same material as the accessory paddle head and be integrally formed with the accessory paddle head; however, this is not required.

Figure 7:
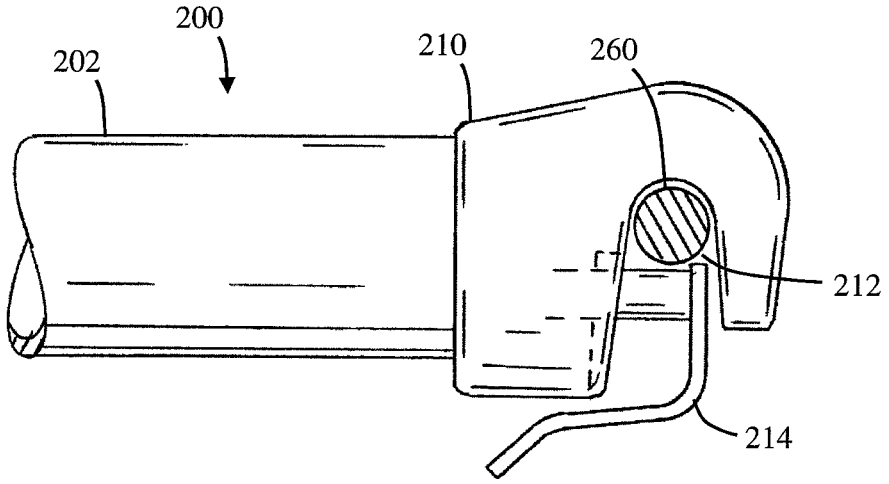
FIG. 7 is a perspective illustration of a spinnaker pole head unit.
Figure 10:
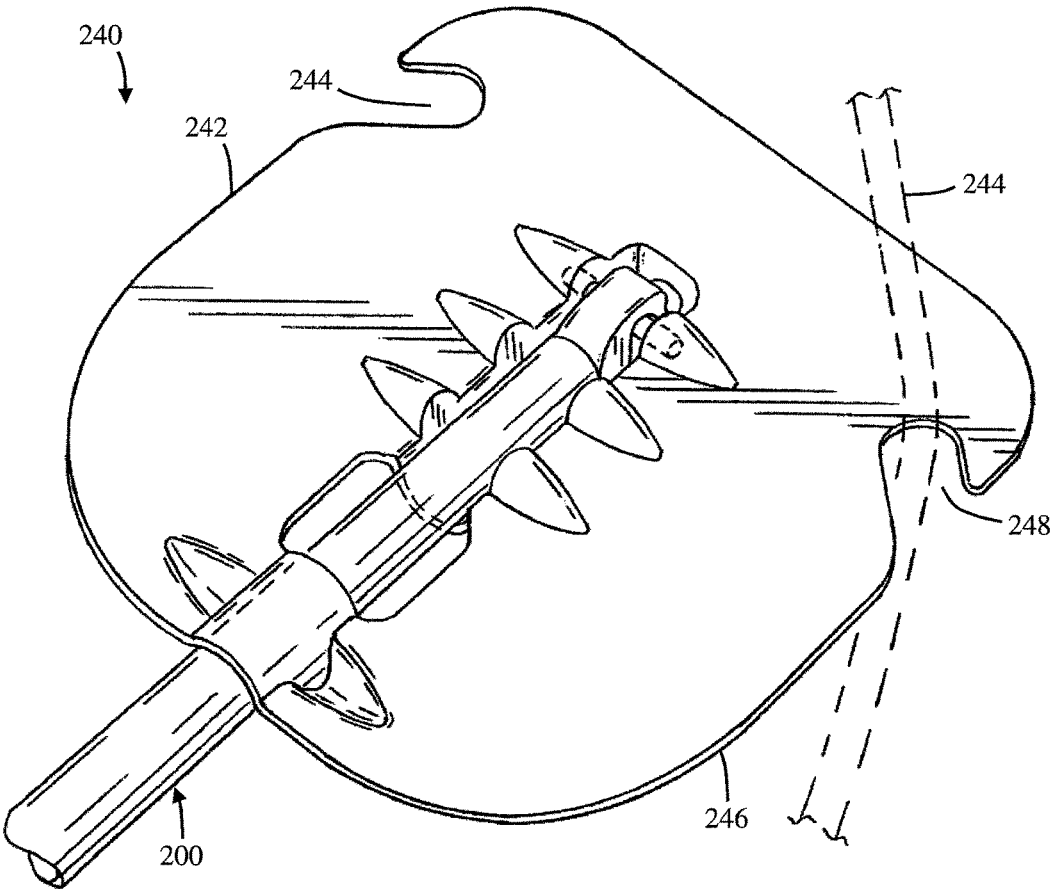

With reference now to FIG. 7, there is provided a perspective illustration of an end portion of a spinnaker pole 200 having a spinnaker pole body 202 and a spinnaker pole head unit 210; however, the spinnaker pole 200 can have other and/or alternative components (not shown). The spinnaker pole head unit 210 is illustrated as comprising a C-shape connection unit defining a slot and/or passage 212 bound by a quick release fitting 214. The quick release fitting 214 is configured to releasably secure to a connection bar 260 such as a dowel pin (that is located on the accessory paddle head) within the slot and/or passage 212 formed by the spinnaker pole head unit 210. When the quick release fitting is connected to the connection bar, the connection can be such that the pole can pivot about the connection bar when the pole is not positioned in the second cavity; however, this is not required. When the quick release fitting is connected to the connection bar, the end of the pole is generally spaced from the back end of the second cavity as illustrated in FIG. 10; however, this is not required.

As illustrated in FIG. 7, the connection bar 260 is illustrated as bring held snug within the slot and/or passage 212 of the spinnaker pole head unit 210. When the spinnaker pole 200 is connected to a boat and not to the accessory paddle head, the spinnaker pole head unit 210 is configured to releasably connect to the mast of the boat as is known in the art.

Figure 8:
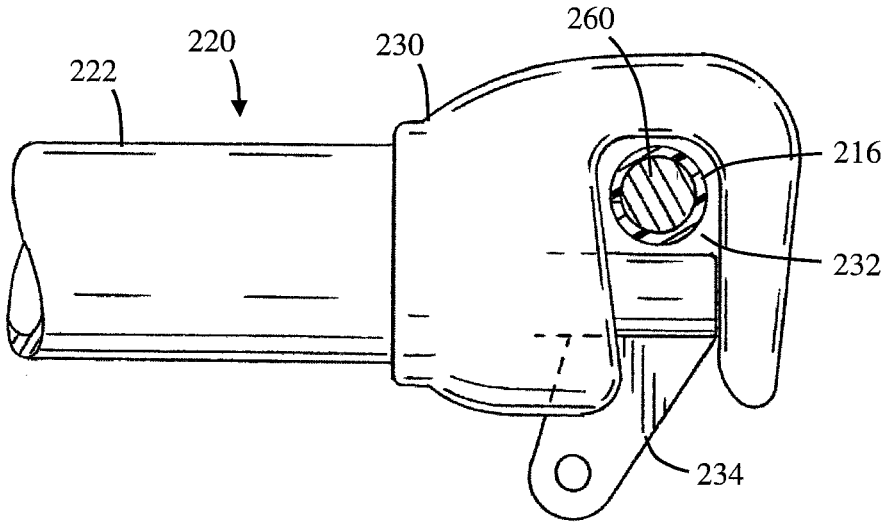
FIG. 8 is a perspective illustration of a spinnaker pole head unit.
Figure 9:
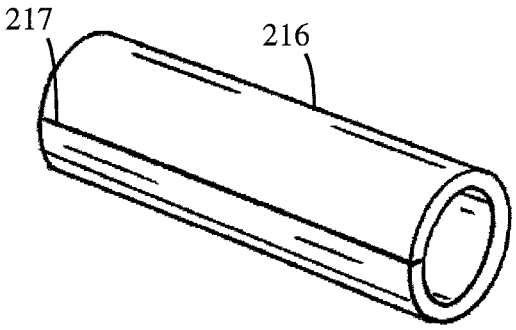
FIG. 9 is a perspective illustration of a bushing which can be used with the accessory paddle head of FIGS. 1-2; and, FIG. 10 is a perspective illustration of an accessory paddle head in accordance with another and/or alternative non-limiting aspect of the present invention.

Referring now to FIGS. 8-9, there is provided a perspective illustration of a spinnaker pole 220 having a spinnaker pole body 222 and a spinnaker pole head unit 230; however, the spinnaker pole 220 can have other and/or alternative components (not shown). The spinnaker pole head unit 230 is illustrated as comprising a C-shape connection unit defining a slot and/or passage 232 bound by a quick release fitting 234. The quick release fitting 234 is configured to releasably secure to connection bar 260 within the slot and/or passage 232 formed by the spinnaker pole head unit 230. In comparison with the spinnaker pole 200 of FIG. 7, the spinnaker pole 220 of FIG. 8 is illustrated as being used in conjunction with a connection bar 260 which is smaller in size than the slot and/or passage 232. Thus, a bushing 216 (see FIGS. 8-9) is provided on the connection bar 260. The bushing 217 can optionally include a slit 217 therein. As best illustrated in FIG. 9, the bushing 216 is illustrated as having a hollow cylindrical shape; however, this is not required. The bushing 216 is illustrated as bring configured to be placed partially or fully around the connection bar 260 of FIG. 8 so as to minimize relative movements of the connection bar 260 within the slot and/or passage 232 of the spinnaker pole head unit 230. The bushing can be configured to be removable from the connection bar; however, this is not required.

When the accessory paddle head 100 is in position on the spinnaker pole 200 as shown in FIGS. 3-4, it serves to hold the spinnaker pole properly from rotating or sliding out and thus maximizes available stroke power when the paddle is in use. Moreover, when arranged as such, the secure nature of the fitting stiffens the provided paddle so that it may be used for heavy or excessive paddling. By supporting the paddle blade on the spinnaker pole, the latter is convenient for use during paddling operations.

In use, overall strength of accessory paddle head 100 when striking the water with one side of the accessory paddle head (e.g., front surface 120) can be the same as when striking the water with the opposite side (e.g., back surface 122). Thus, the overall strength of the provided accessory paddle system is increased and is due in part to the means of detachably securing the accessory paddle head 100 to the spinnaker pole 200.

When fully engaged, spinnaker pole 200 is detachably secured to accessory paddle head 100 such that gripping members 180, 181, 182, 183, 184, 185, 186, 187 resiliently embrace the spinnaker pole 200 for the retention of the accessory paddle head 100 on the spinnaker pole 200 in the first and second cavities of accessory paddle head 100. As illustrated in FIG. 2, the adjacently positioned gripping members on each side of the second cavity are positioned at equal distances to one another; however, this is not required.

With reference now to FIG. 10, there is illustrated an accessory paddle head 240 which includes a first cutout 244 on side edge 242, and a second cutout 248 on side edge 246. The first and second cutouts 244, 248 are illustrated as being configured to serve the purpose of a boat hook for pulling in a line and/or rope 250.

When a spinnaker pole is to be connected to the accessory paddle head, the end of the spinnaker pole that includes the pole head unit 230 is inserted through pole opening 150 from the bottom surface of the accessory paddle head. The end of the spinnaker pole that includes the pole head unit 230 is then inserted into the second cavity. The quick release fitting on the pole head unit 230 is aligned with upper opening 146 such that when the end of the spinnaker pole is positioned in the second cavity, the end of the quick release fitting partially passes through the upper opening. The end of the spinnaker pole is secured in the second cavity by connecting the end of the spinnaker pole quick release fitting to connection bar 260. The gripping members positioned about the second cavity facilitate in maintaining the spinnaker pole in the second cavity. When the spinnaker pole is connected to the connection bar, such connection inhibits or prevents the rotation of the spinnaker pole relative to the accessory paddle head when the spinnaker pole is positioned in the second cavity. The gripping members can optionally be configured to also inhibit or prevent the rotation of the spinnaker pole relative to the accessory paddle head when the spinnaker pole is positioned in the second cavity. After the quick release fitting is connected to the connection bar, the spinnaker pole can be moved downwardly toward the first cavity and then positioned into the first cavity. The gripping members that are positioned about the first cavity can optionally be configured to also inhibit or prevent the rotation of the spinnaker pole relative to the accessory paddle head when the spinnaker pole is positioned in the first cavity. Once the spinnaker pole is positioned in the first and second cavities of the accessory paddle head, the spinnaker pole and accessory paddle head can be used as a paddle. When the spinnaker pole is to be removed from the accessory paddle head, the operations as discussed above regarding the connection of the spinnaker pole to the accessory paddle head are reversed.

The invention has been described with reference to a number of different embodiments. It is to be understood that the invention is not limited to the exact details of construction, operation, exact materials or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

What is claimed:

1. An accessory paddle head configured to releasably connect to a pole to provide an accessory paddle system, said accessory paddle head comprising:

a first pole connection arrangement that includes a first cavity, said first cavity having a top opening;

a primary pole retention arrangement having a second cavity, said second cavity having a top opening, said top opening of said first cavity facing one side of said accessory paddle head and said top opening of said second cavity facing an opposite side of said accessory paddle head;

a first set of gripping members positionable adjacent to said top opening of said first cavity, said first set of gripping members configured to releasably secure a first portion of said pole in said first cavity; and, a second set of gripping members positionable adjacent to said top opening of said second cavity, said second set of gripping members configured to releasably secure a second portion of said pole in said second cavity.

2. The accessory paddle head as defined in claim 1, wherein said first and second cavities are spaced from one another.

3. The accessory paddle head as defined in claim 2, wherein a pole opening is positioned between said first and second cavities, said pole opening having a shape and size to allow an end of said pole to be passed fully through said pole opening.

4. The accessory paddle head as defined in claim 1, wherein the accessory paddle head has a generally square shaped body.

5. The accessory paddle head as defined in claim 1, wherein said second cavity includes an upper opening that is sized and shaped to enable a quick release fitting on the pole head unit to at least partially pass through said upper opening when a portion of the pole is positioned in said second cavity.

6. The accessory paddle head as defined in claim 1, including a connection bar that is positioned at least partially across a width of said second cavity, said connection bar configured to releasably connect to a quick release fitting on the pole head unit when a portion of the pole is positioned in said second cavity.

7. The accessory paddle head as defined in claim 5, including a connection bar that is positioned at least partially across a width of said second cavity, said connection bar configured to releasably connect to the quick release fitting on the pole head unit when said portion of the pole is positioned in said second cavity.

8. The accessory paddle head as defined in claim 6, wherein only a portion of said connection bar is positioned in said second cavity.

9. The accessory paddle head as defined in claim 6, wherein said connection bar includes a removable bushing.

10. The accessory paddle head as defined in claim 1, wherein at least a portion of a peripheral region of said accessory paddle head has a tapered thickness.

11. The accessory paddle head as defined in claim 1, including a first cutout on a side edge of said accessory paddle head.

12. The accessory paddle head as defined in claim 1, wherein said pole is a spinnaker pole.

13. The accessory paddle head as defined in claim 1, wherein said first set of gripping members includes first and second gripping members, said first griping member positioned on one side of said first cavity and said second gripping member positioned on an opposite side of said first cavity.

14. The accessory paddle head as defined in claim 1, wherein said second set of gripping members includes first, second, third and fourth gripping members, said first and second griping members positioned on one side of said second cavity and said third and fourth second gripping members positioned on an opposite side of said second cavity.

15. An accessory paddle head configured to releasably connect to a pole to provide an accessory paddle system, said accessory paddle head comprising:

a first pole connection arrangement that includes a first cavity, said first cavity having a top opening;

a primary pole retention arrangement having a second cavity, said second cavity having a top opening, said top opening of said first cavity facing one side of said accessory paddle head and said top opening of said second cavity facing an opposite side of said accessory paddle head, said second cavity includes an upper opening that is sized and shaped to enable a quick release fitting on the pole head unit to art least partially pass through said upper opening when a portion of the pole is positioned in said second cavity.

16. The accessory paddle head as defined in claim 15, wherein said first and second cavities are spaced from one another.

17. The accessory paddle head as defined in claim 16, wherein a pole opening is positioned between said first and second cavities, said pole opening having a shape and size to allow an end of said pole to be passed fully through said pole opening.

18. The accessory paddle head as defined in claim 15, wherein the accessory paddle head has a generally square shaped body.

19. The accessory paddle head as defined in claim 15, including a first set of gripping members positionable adjacent to said top opening of said first cavity, said first set of gripping members configured to releasably secure a first portion of said pole in said first cavity, and including a second set of gripping members positionable adjacent to said top opening of said second cavity, said second set of gripping members configured to releasably secure a second portion of said pole in said second cavity.

20. The accessory paddle head as defined in claim 15, including a connection bar that is positioned at least partially across a width of said second cavity, said connection bar configured to releasably connect to a quick release fitting on the pole head unit when a portion of the pole is positioned in said second cavity.

21. The accessory paddle head as defined in claim 19, including a connection bar that is positioned at least partially across a width of said second cavity, said connection bar configured to releasably connect to the quick release fitting on the pole head unit when said portion of the pole is positioned in said second cavity.

22. The accessory paddle head as defined in claim 20, wherein only a portion of said connection bar is positioned in said second cavity.

23. The accessory paddle head as defined in claim 20, wherein said connection bar includes a removable bushing.

24. The accessory paddle head as defined in claim 15, wherein at least a portion of a peripheral region of said accessory paddle head has a tapered thickness.

25. The accessory paddle head as defined in claim 15, including a first cutout on a side edge of said accessory paddle head.

26. The accessory paddle head as defined in claim 15, wherein said pole is a spinnaker pole.

27. The accessory paddle head as defined in claim 19, wherein said first set of gripping members includes first and second gripping members, said first griping member positioned on one side of said first cavity and said second gripping member positioned on an opposite side of said first cavity.

28. The accessory paddle head as defined in claim 19, wherein said second set of gripping members includes first, second, third and fourth gripping members, said first and second griping members positioned on one side of said second cavity and said third and fourth second gripping members positioned on an opposite side of said second cavity.

29. A method for forming an accessory paddle system comprising the steps of:

providing a pole, said pole having a first end and a second end;

providing an accessory paddle head configured to releasably connect to said pole to provide said accessory paddle system, said accessory paddle head comprising:

a first pole connection arrangement that includes a first cavity, said first cavity having a top opening;

a primary pole retention arrangement having a second cavity, said second cavity having a top opening, said top opening of said first cavity facing one side of said accessory paddle head and said top opening of said second cavity facing an opposite side of said accessory paddle head;

releasably connecting a first end portion of said pole to said second cavity; and, releasably connecting a portion of said pole that is rearward of said first end portion of said pole to said first cavity.

* * * * *